US008488980B2

(12) United States Patent
Yoshida

(10) Patent No.: US 8,488,980 B2
(45) Date of Patent: Jul. 16, 2013

(54) IMAGE FORMING APPARATUS CAPABLE OF FORMING HIGH QUALITY TONER IMAGE ON UNEVEN SURFACE SHEET

(75) Inventor: Ken Yoshida, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 289 days.

(21) Appl. No.: 12/938,663

(22) Filed: Nov. 3, 2010

(65) Prior Publication Data

US 2011/0103810 A1 May 5, 2011

(30) Foreign Application Priority Data

Nov. 4, 2009 (JP) ..... 2009-253082

(51) Int. Cl.
*G03G 15/08* (2006.01)

(52) U.S. Cl.
USPC ..... 399/27; 399/257; 399/258

(58) Field of Classification Search
USPC ..... 399/27, 29, 45, 61, 257, 258
See application file for complete search history.

(56) References Cited

U.S. PATENT DOCUMENTS

| | | | | |
|---|---|---|---|---|
| 2003/0228159 | A1* | 12/2003 | Tungate et al. | 399/27 |
| 2004/0000230 | A1* | 1/2004 | Tanimoto | 95/19 |
| 2006/0029405 | A1* | 2/2006 | Tanaka et al. | 399/27 |
| 2007/0047985 | A1* | 3/2007 | Kamijo et al. | 399/45 |
| 2008/0152366 | A1* | 6/2008 | Endou et al. | 399/27 |

FOREIGN PATENT DOCUMENTS

| | | |
|---|---|---|
| JP | 9-62083 | 3/1997 |
| JP | 3171345 | 3/2001 |
| JP | 2006-78976 | 3/2006 |
| JP | 2007-108623 | 4/2007 |
| JP | 4070400 | 1/2008 |
| JP | 2008-261935 | 10/2008 |

* cited by examiner

*Primary Examiner* — David M. Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

An image forming apparatus for forming a visual image on a recording medium includes a toner replacing device that replaces toner stored in a developing device with fresh toner, and a determiner that determines if a recording medium selected by a user necessitates replacement of the toner. The toner replacing device replaces the toner with fresh toner when the determiner determines that the recording medium necessitates replacement of the toner before the latent image is formed on a photoconductive member.

9 Claims, 8 Drawing Sheets

| SHEET TYPE | CONSUMED TONER AMOUNT | REPLENISHMENT TONER AMOUNT |
|---|---|---|
| A | $\alpha$ [mg] | $\alpha$ [mg] |
| B | $\beta$ [mg] | $\beta$ [mg] |
| C | $\gamma$ [mg] | $\gamma$ [mg] |

IMAGE FORMING APPARATUS CAPABLE OF FORMING HIGH QUALITY TONER IMAGE ON UNEVEN SURFACE SHEET

CROSS-REFERENCE TO RELATED APPLICATIONS

This application claims priority pursuant to 35 USC §119 to Japanese Patent Application No. 2009-253082, filed on Nov. 4, 2009, the entire contents of which are hereby incorporated by reference herein.

BACKGROUND OF THE INVENTION

1. Field of the Invention

The present invention relates to an image forming apparatus, such as a copier, a printer, a facsimile machine, a multifunctional machine having several of these functions, etc.

2. Description of the Background Art

A conventional image forming apparatus generally employs a developing process for visualizing a latent image formed on a photoconductive member.

In the developing process, two-component developer including carrier and toner attracted to the carrier, or one-component developer only including toner, is utilized. Typically, the developer is supplied to a latent image by a contact system that makes the developer contact and attracts the toner to the surface of the photoconductive member by an electrostatic force at a gap formed between the latent image and the developer. Alternatively, a non-contact system that makes toner soar in an electric field generated by a developing bias and attracts the toner to the latent image is known.

In such a developing process, when the toner having a prescribed amount of charge and the latent image having a prescribed electrostatic force are balanced electrostatically excess toner detaches from the latent image and is not used but collected by the developing device as unused toner.

Such collected and unused toner sometimes causes problems. For example, the toner is charged triboelectrically because it is stirred and mixed in the developing device before being supplied to the latent image, or subjected to friction at a gap between a surface of the developing roller arranged facing a latent image carrier and a blade arranged approximating the surface of the developing roller in the developing device.

In particular, in a developing system using one-component developer, a toner layer is uniformly made into a thin layer on a surface of a developing roller, such as a metal roller, etc., and causes toner to soar and reach a latent image. In such a situation, due to friction caused by the blade for thinning the toner layer and that caused between toner particles on the surface of the developer roller, as well as stress generated by stirring and mixing thereof in conveyance and stirring steps, performance of the toner, such as charge performance, powder performance, etc., sometimes degrades.

The deterioration of toner, especially that of the performance of powder toner, is probably caused by external additives. More specifically, when fine-powder external additives, such as hydrophobic silica, titan oxide, alumina, fatty acid metal, etc., which is included in the developer to adjust fluidity, charge amount, or cleaning performance, receives friction and stirring stress, these additives bury into the toner as time elapses.

Toner with such external additives increasingly generates an intensive attraction, and adversely affects a transfer process. Since the degraded toner exerts an intensive attraction on a photoconductive member or an intermediate transfer member, the toner is hardly transferred. In particular, the toner is barely transferred onto concavities in the surface of the paper even if a transfer electric field is applied as appropriate. Accordingly, such toner heavily affects the transfer process for a sheet having a low surface smoothness, and as a result, image quality is significantly degraded.

Further, such toner also provokes toner scattering and background staining. The toner is replenished to appropriately adjust density of the developer as developer density decreases. However, when fresh toner is introduced into a developing device and is mixed with degraded toner remaining therein (hereinafter, referred to as degraded toner), the degraded toner is charged to an opposite polarity due to friction therebetween. As a result, the developing roller cannot hold the degraded toner, causing toner scattering. At same time, the degraded toner is attracted by a voltage of the background of the photoconductive member, and stains the background thereof.

Conventionally, to prevent the above-mentioned problem caused by degraded toner, a method of replacing toner on a prescribed condition, or that of forcibly consuming toner by forming and collecting a consumption pattern with a cleaner for cleaning a photoconductive member or an intermediate transfer belt per image formation, has been proposed as described in Japanese Patent No. 3171345, and Japanese Patent Application Laid Open Nos. 2007-108623 and 2008-261935 (JP-2007-108623-A and JP-2008-261935-A, respectively).

However, depending on a type of a sheet used for image formation, toner replenishment is not necessarily executed, because to do so that toner is wasted and thereby running cost increases.

SUMMARY OF THE INVENTION

Accordingly, an object of the present invention is to provide a new and novel image forming apparatus that forms a visual image on a recording medium from a latent image. Such a new and novel image forming apparatus includes a toner replacing device that replaces toner stored in a developing device with fresh toner, and a determiner that determines if a recording medium selected by a user necessitates replacement of the toner. The toner replacing device replaces the toner with fresh toner when the determiner determines that the recording medium necessitates replacement of the toner before the latent image is formed on the photoconductive member.

In another aspect, an amount of the toner replaced by the toner-replacing device is changed in accordance with a type of the recording medium selected by the user.

In yet another aspect, a memory is provided to store an amount of toner to be replaced by the toner-replacing device per type of recording medium. The amount of the toner to be replaced is determined in accordance with the information stored in the memory before the toner is replaced.

In yet another aspect, a vacuuming device is provided to vacuum air in the developing device when the toner is replaced.

In yet another aspect, the vacuuming device vacuums the air more intensely when the toner is replaced with fresh toner than when an ordinary operation is executed.

In yet another aspect, the toner is replaced with fresh toner after the toner stored in the developing device has been consumed.

In yet another aspect, the toner is consumed to replace with fresh toner by forming and removing a toner consumption pattern from one of the surface of the photoconductive member and that of a transfer member that receives transfer of the toner consumption pattern from the photoconductive member. The toner consumption pattern is divided into multiple segments per replacement of the toner, which are arranged on the surface of the photoconductive member at a prescribed interval in a surface moving direction.

In yet another aspect, the toner is consumed to be replaced with fresh toner by forming and removing a toner consumption pattern with a cleaner from one of the surface of the photoconductive member and that of a transfer member that receives the toner consumption pattern from the photoconductive member. A width of the toner consumption pattern is smaller than that of the cleaning member.

In yet another aspect, the toner is consumed to be replaced with fresh toner by forming and removing a toner consumption pattern with a cleaning member from one of the surface of the photoconductive member and that of a transfer member that receives the toner consumption pattern from the photoconductive member. A transfer efficiency of the toner consumption pattern transferred from the photoconductive member onto the transfer member is lower than that of a toner image transferred from the photoconductive member onto the transfer member during a normal toner image transfer operation.

In yet another aspect, plural photoconductive members carry latent images, and plural developing devices develop the latent images. The toner is consumed before being replaced with fresh toner by forming and removing toner consumption patterns from one of the plural photoconductive members and a transfer member that receives the toner consumption patterns from the plural photoconductive members. The respective toner consumption patterns are superimposed on the same section of the transfer member.

In yet another aspect, no more than three toner consumption patterns are superimposed on the same section of the transfer member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
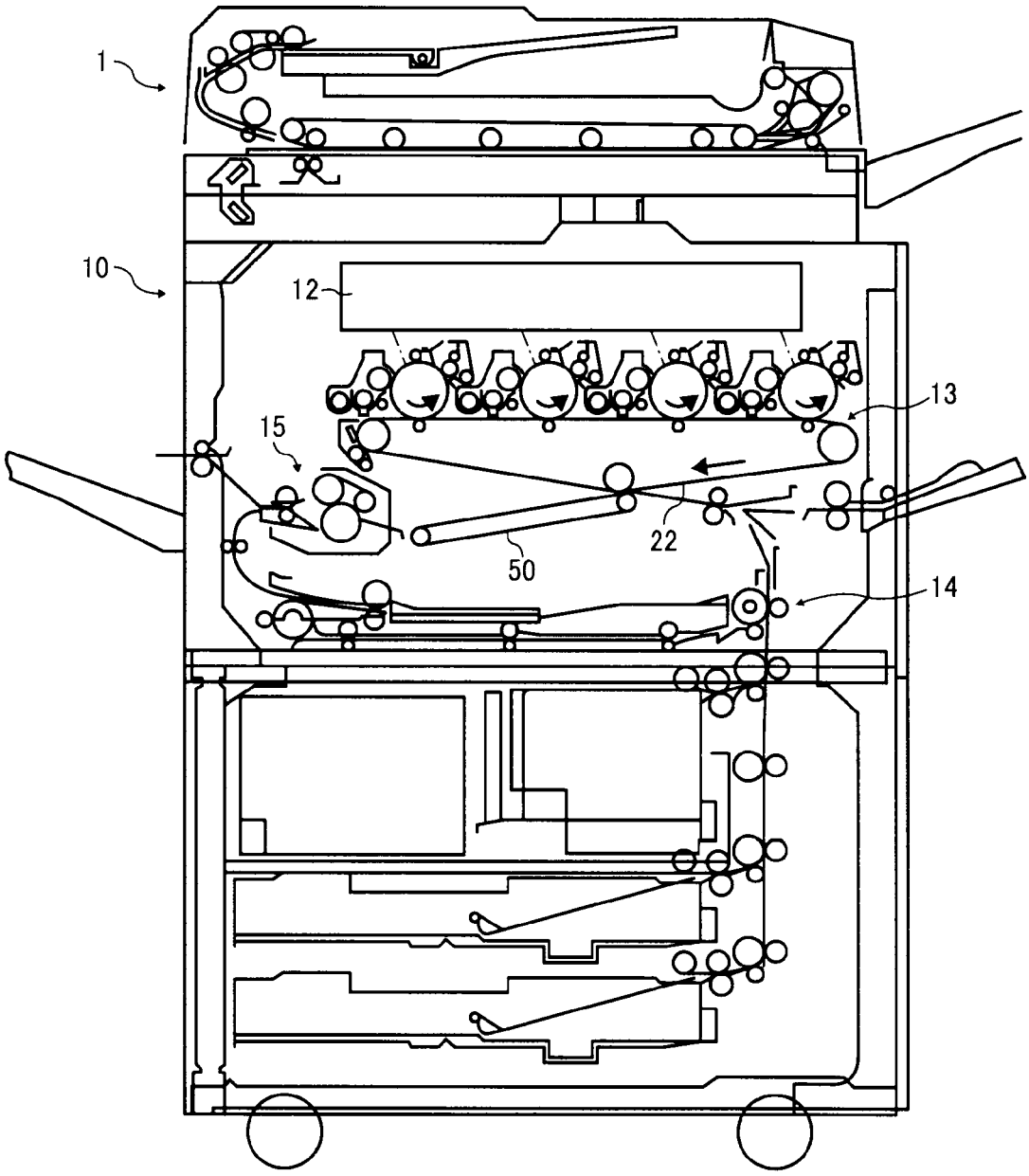
FIG. 1 illustrates an exemplary electro-photographic apparatus according to one embodiment of the present invention.
Figure 2:
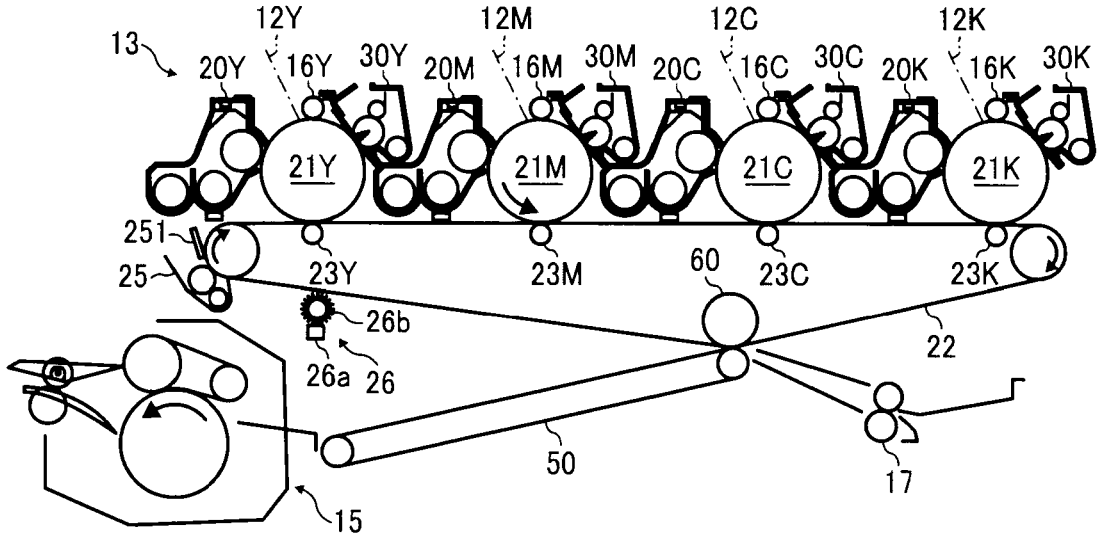
FIG. 2 illustrates an exemplary image formation section of the electro-photographic apparatus of FIG. 1.

Referring now to the drawing, wherein like reference numerals designate identical or corresponding parts throughout several views, in particular in FIG. 1, an entire electro-photographic apparatus 10 according to one embodiment of the present invention is disclosed. As shown there, the electro-photographing apparatus 10 includes an image writing section 12, an image formation section 13, and a sheet feeding section 14 or the like for collectively forming a color image using an electro-photographic system. The image formation section 13 is included in the image formation section 10 as shown in FIG. 2.

Initially, an exemplary structure and operation of the electro-photographing apparatus 10 is briefly described with reference to FIG. 1. As shown, an image signal subjected to image processing in an image processing section 1 provided in a upper section of the electro-photographing apparatus 10 is converted into yellow, magenta, cyan, and black color signals for respective image formations and are transmitted to an image writing section 12. The image writing section 12 includes a laser scan optical system that has a laser light source, a deflection member, such as a polygon mirror, etc., a scan imaging optical system, and a mirror group and the like. Also included is a LED writing system that has a LED array with alignment of plural LEDs in one or two dimension or the like, and four writing light paths 12Y to 12K in correspondence with the respective color signals. The image writing section 12 writes images onto the photoconductive members 21Y to 21K of the four image formation units provided in the image formation section 13 via the four writing paths 12Y to 12K in accordance with respective color signals as shown in FIG. 2.

An OPC is generally employed as each of the photoconductive members 21Y to 21K of yellow to black colors. Further, around the photoconductive members 21Y to 21K, respective chargers 16Y to 16K, exposure sections exposed to laser lights emitted from the image writing section 12, developing devices 20Y to 20K for yellow to black, primary transfer bias rollers 23Y to 23K, and photoconductive member cleaners 30Y to 30K are arranged.

A two-component magnetic brush developing system is employed in each of the developing devices 20Y-K. An intermediate transfer belt 22 is stretched intervening the respective photoconductive members 21Y-K and the primary transfer bias rollers 23Y-K to receive and superimposes respective color toner images one after another from the photoconductive members.

A sheet fed from a sheet feeding section 14 of the electro-photographing apparatus 10 is carried on a transfer conveyance belt 50 via a pair of registration rollers 17 as shown in FIG. 2. Then, at a contact between the intermediate transfer belt 22 and the transfer conveyance belt 50, the toner image transferred onto the intermediate transfer belt 22 is further transferred onto the sheet as a secondary transfer process at once by a secondary transfer bias roller, whereby a color image is formed thereon. The sheet P with the color image is then conveyed to a fixing device 15 by the transfer conveyance belt. The color image is then fixed onto the sheet P by the fixing device 15. The sheet P is then ejected out of the electro-photographing apparatus 10.

The toner not transferred during the secondary transfer and remaining on the intermediate transfer belt 22 is removed by a cleaning blade 251 or the like provided in a transfer-cleaner 25. At downstream on the intermediate transfer belt 22 of the transfer cleaner 25, there is provided a lubricant coating device 26 having a solid lubricant 26*a* and a conductive brush 26*b* that sliding contacts and coats the intermediate transfer belt 22 therewith. The solid lubricant 26*a* improves a cleaning performance and durability of the intermediate transfer belt 22 by avoiding generation of filming thereon.

The respective surfaces of the photoconductive members 21Y-K are uniformly charged at about −700V by the respective chargers 16Y-K arranged upstream of the writing paths 12Y-K. A non-contact type charge roller in relation to a photoconductive member or a contact type charge roller, such as a corotron, scorotron, etc., can be used as the charger. A superimposed bias generated by superimposing DC and AC or a DC bias generated only by a DC can be used for the above-mentioned bias.

After charging of the respective surfaces of the photoconductive members 21Y-K, the above-mentioned image writing sections 12 execute image writing onto those surfaces. Hence, latent images corresponding to yellow to black are formed on the photoconductive members 21Y-K, respectively. These latent images are developed by the developing devices 20Y-K of yellow to black colors.

Now, the developing devices 20Y-K are more specifically described with reference to FIG. 3. Each of the developing devices 20Y-K includes a developing roller 201, a doctor blade 202, a pair of screws 203 and 204, a toner density sensor 205, a developing casing 206 and the like. The pair of screws 203 is arranged obliquely below the developing roller 201 in parallel to each other. A partition 206*a* is arranged in the developing casing to separate the pair of screws 203 and form chambers, separately. Plural cutaways are formed on the partition 206*a* at front and rear sides, respectively, so that the pair of screws can circulate the developer stored in the respective chambers in the casing 206.

An opening section 206*b* is formed on the developing casing 206 that faces the photoconductive member with the developing roller 201 partially protruding there through. Further, the developing roller 201, the screws 203 and 204, the doctor blade 202 are arranged such that a space above the screw 204 becomes slightly larger than other sections in the developing casing 206. To develop the above-mentioned respective component color latent images, developers of respective component colors of yellow to black are stored in the developing casings 206 of the respective developing devices 20Y-K. Two-component developer including dispersion mixture of non-magnetic toner and magnetic carrier is utilized in this embodiment.

The developer in the respective developing devices 20Y-K is conveyed being stirred all the time by the pair of screws 203 and 204 rotating in the opposite direction to each other in the respective chambers of the developing casing 206 through their front and rear side cutaways. The developer is then supplied toward the developing roller 201 by the screws 204. The developing roller 201 includes a magnetic roller 201*a* to generate a magnetic field and a non-magnetic developing sleeve 201*b* that is retractably provided to cover an outer circumference of the magnetic roller 201*a*.

The developer supplied to the developing roller 201 in this way is lifted up and held on the surface of the developing sleeve 201*b* and forms a magnetic brush thereon due to magnetic force of the magnetic roller 201*a* as the developing sleeve 201*b* rotates. The developer of the magnetic brush on the surface of the developing sleeve 201*b* is conveyed being driven by rotation of the developing sleeve 201*b* toward the opening section 206*b* of the developing casing 206. A head of the developer is cut by the doctor blade 202 before reaching the opening section 206*b* so that the developer has an appropriate amount.

The developer is then conveyed to a developing region located between the surface of the developing roller 201 protruding from the opening section 206*b* and that of the photoconductive member.

The developer with its head being cut by the doctor blade 202 and thus blocked to proceed to the developing region drops along the outer circumference of the developer of the magnetic brush held on the surface of the developing sleeve 210*b* onto the screw 204 by it own gravity, whereby being returned to a circulation conveyance path in the developing casing 206. The developer is then stirred and conveyed by the pair of screws 203 and 204 again, and is supplied to the developing roller 201 again by the screw 204.

Further, the developer conveyed to the developing region visualizes the latent image on the photoconductive member by moving the toner thereto, whereby a toner image is formed thereon. A developing bias of ac peak-to-peak voltage of about 1 kV with 2.25 kHz regarding −500V as a center is applied onto the above-mentioned developing sleeve 201*b*. With the developing bias a difference in charge voltage of about −150V is created between an exposure section on the photoconductive member and the developing sleeve 201*b*, and the toner in the developer moves to the latent image thereon.

Surplus developer of the toner and carrier not consumed in visualizing of the latent image is returned to the developing casing 206 while being held on the developing sleeve 201*b*. Then, at a section on the surface of the developing sleeve 201*b*, where the magnetic force of the magnetic roller 201*a* is not effective, the surplus developer separates therefrom and drops onto the screw 204 by its own gravity. Thus, the surplus developer is collected by the circulation conveyance path of the developing casing 206 and is stirred and conveyed by the pair of screws 203 and 204 again. The surplus developer is then supplied to the developing roller 201 again by the screw 204.

In this way, the above-mentioned developer is repeatedly supplied and collected to and from the developing sleeve 201*b* while being stirred and conveyed by the pair of screws 203 and 204 and circulating therein. When the developing process for visualizing the latent image on the photoconductive member is repeated, and toner consumption is promoted, density of toner in the developer stored in the developing casing 206 gradually decreases, accordingly. Then, plural toner density sensors 205 detect the toner density of the developer stored in the developing casing 206 in the developing devices 20Y-K, respectively.

Based on detection result of the toner density sensor 205, toner replacement devices, not shown, replenish fresh toner to the developing casing 206 appropriately, so that the density of the toner of the developer in the developing casing 206 can be a prescribed level all the time.

Hence, the toner images of respective component colors on the photoconductive members 21Y-K are transferred and superimposed on a surface of the intermediate transfer belt 22, which rotates contacting the surfaces of the photoconductive members, by primary transfer bias rollers 23Y-K, respectively, one after another during a primary transfer process. Specifically, the primary transfer bias rollers 23Y-K are arranged facing the respective photoconductive members almost to sandwich the intermediate transfer belt 22 and generate transfer electric fields in primary transfer regions located between the respective photoconductive members and the intermediate transfer belt 22. Thus, the toner images on the photoconductive members are electro-statically transferred onto the intermediate transfer belt 22.

A conductive sponge roller is utilized for each of the above-mentioned primary transfer bias rollers 23. To provide the conductivity, ion conductive agent or electronic conductive agent, such as carbon, etc., can be mixed into rubber. However, a roller using certain amounts of the electronic conductive agent generally shows uneven resistance and is not favorable when obtaining a fine transfer performance.

Then, a transfer bias is applied to the primary transfer bias roller made of ion conductive foam NGR rubber having Asker-C hardness of 40 degree and a resistance of $10^7$ ohm to generate the transfer electric filed in this embodiment.

Various materials can be utilized as the above-mentioned intermediate transfer belt 22. A multiple layer structure belt produce as mentioned below is preferably employed in this embodiment.

Specifically, a polyurethane layer is formed on one of a polyimide belt having excellent durability and high Young's modulus, a Pvdf belt having excellent surface smoothness, and a polyurethane resin layer. An elastic layer of a coat layer including fluorine component is provided over the polyurethane rubber layer.

As one example, a polyimide resin, which is best suitable material in view of intensity, is used for the intermediate transfer member, so that surface resistivity is $1\times10^{11}$ ohm and a cubic resistivity of $1\times10^{9}$ ohmcm.

An intermediate transfer belt made of polyimide is produced by the below-described method. Initially, carbon black is dispersed into solvent of polyamide acid. The dispersion liquid is then flown into a metal drum and is dehydrated. A film is then peeled off from the metal drum, and is stretched in high temperature, thereby a polyimide film is produced. Then, the polyimide film is clipped having an appropriate size, and an endless belt made of polyimide resin is produced.

A film is molded using a typical method as described below. Polymer solvent including carbon black dispersed thereinto is poured into a cylindrical metal mold.

The cylindrical metal mold is then rotated being heated to 100 to 200 degree centigrade using centrifugal molding, whereby a film is molded. The above-mentioned film is separated from the mold in a semisolid state and is wrapped around an iron core. Then, polyimide reaction is promoted at 300 to 450 degree centigrade to be hardened, so that an intermediate transfer belt is obtained. At this moment, a performance of the belt can be adjusted by changing a carbon amount, a burning temperature, and hardening velocity or the like. With this method, both a cubic resistivity and a surface resistivity can also be adjusted. To measure the cubic resistivity and the surface resistivity, a High Lester UP (MCP-HT450) manufactured by Mitsubishi Chemical Corp. is used. As a probe, a URS probe (MCP-HTP14) manufactured by Mitsubishi Chemical corp. is used.

By superimposing respective toner images of component colors formed on the photoconductive members 21Y-K one after another on the surface of the intermediate transfer belt 22 in a primary transfer process as mentioned above, a full-color image of four component colors is formed thereon. The full-color toner image on the intermediate transfer belt 22 is transferred at once onto a sheet, which is fed by the registration roller 17 and carried on the transfer sheet conveyance belt 50, by secondary transfer bias roller 60 in a secondary transfer process.

The sheet with the full-color image is conveyed to the fixing device by the transfer conveyance belt 50, and is subjected to fixing process there. The sheet is then ejected out of the printer body. Toner remaining on the intermediate transfer belt 22 during the secondary transfer process is removed by the transfer member-cleaner 25 from the intermediate transfer belt 22. Then, the next image is formed by the respective component color image formation units in the image formation section 13.

Now, photoconductive member cleaners 30Y-K which respectively remove toner remaining on the photoconductive members after the primary transfer process are described.

As a cleaning member, a combination of a cleaning blade 301 made of polyurethane rubber and an electro-conductive fur bush is provided in each of the photoconductive member cleaners. An electric filed roller 303 made of metal contacts the fur brush 302. Further, a scraper 304 contacts the electric filed roller 303.

Figure 3:
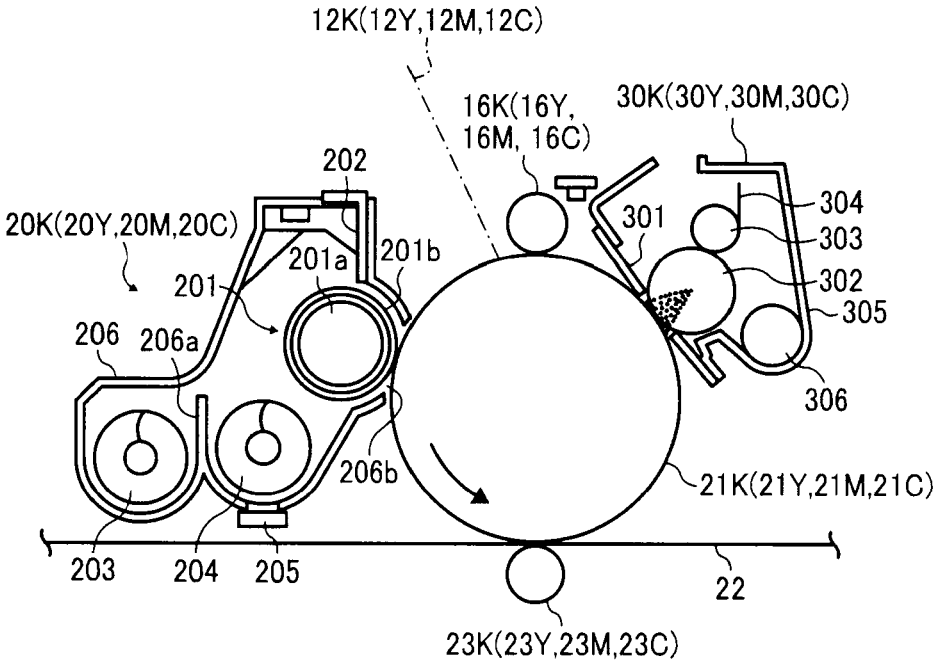
FIG. 3 illustrates an exemplary image formation unit provided in the image formation section of FIG. 2.

As shown in FIG. 3, the toner remaining on the photoconductive member is scraped off from the photoconductive member by the fur brush 302 rotating counter clockwise as the photoconductive member rotates. At this moment, the toner attracted to the fur brush 302 is attracted to the electric filed roller 303 rotating counter clockwise as the fur brush 302 rotates, and is removed. Further, the toner attracted to the electric filed roller 303 is scraped off and drops by the scraper 304, and is collected in the cleaning casing 305. A cleaning bias is applied to the electric filed 303. Thus, by an electrostatic force of the cleaning bias, toner remaining on the photoconductive member is moved from the fur brush 302 to the electric filed roller 303, and is scraped off and drops by the scraper 304 therefrom. The toner collected in this way in the cleaning casing 305 is conveyed to a waste toner bottle, not shown, by a collection screw 306.

Further, in an electro-photographic apparatus, beside the above-mentioned full-color mode for forming a full-color image using all of the four component color toners, a monochrome mode for forming a monochrome image using toner of one of yellow to cyan component colors, a dual color mode for forming dual color images using dual color toners (e.g. a green image of a combination of yellow and cyan, a red image of a combination of yellow and magenta, a cyan or a yellow with black character thereon), and a triple color mode can be executed.

As mentioned above, in the electro-photographing apparatus, the toner not consumed to visualize the latent image in the developing process is returned to the developing casing. Thus, the toner returned to the developing casing degrades some times due to conveyance and stirring thereof in the developing casing. Thus, if an image is formed in such a condition, defective transfer likely occurs. Then, one embodiment of the present invention replaces toner in the developing device.

Figure 4:
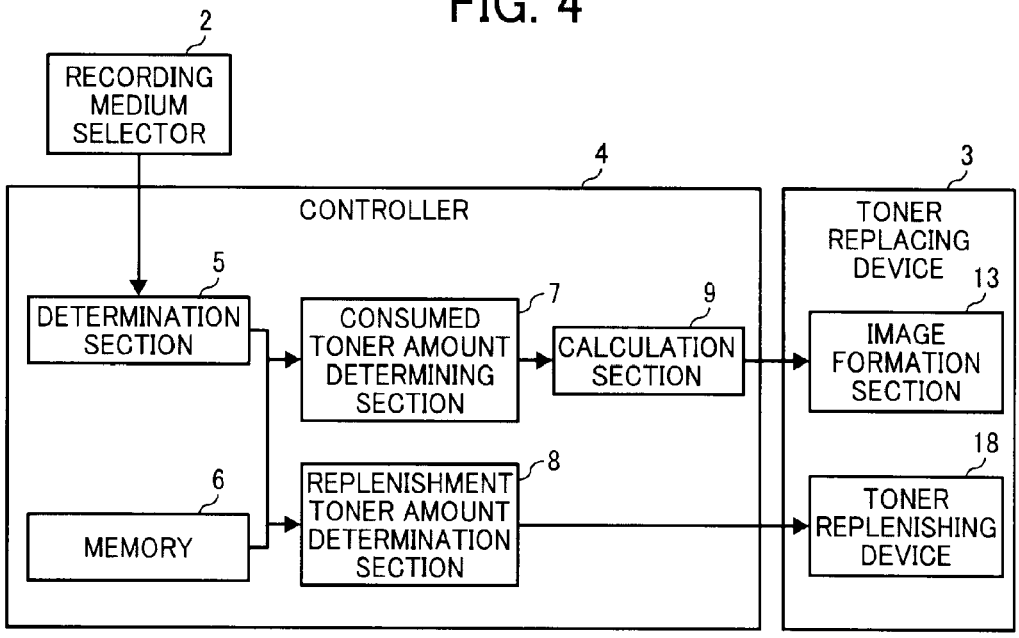
FIG. 4 illustrates an exemplary control system for controlling toner replacement in a developing device.

Now, an exemplary sequence for replacing the toner stored in the developing device is described with reference to FIG. 4. As shown in FIG. 4, the electro-photographing apparatus of this invention includes a recording medium selection device 2 that selects a type of a sheet used for image formation, a toner replacement device 3 that replaces toner in a developing device, and a control device 4 that controls the toner replacement device 3 based on the selection result of the recording medium selection device 2.

An operation panel arranged on the electro-photographing apparatuses or a personal computer connected thereto or the like can be the recording medium selection device 2. Specifically, a sheet type is selected through the operation panel or an operation screen of the personal computer when a copying operation or a printing operation is executed.

The toner replacement device 3 includes the above-mentioned image formation section 13 and a toner replenishment device 18 that replenishes toner into the developing casing 206 of FIG. 3. The image formation section 13 serves as a toner consumption device that forcibly consumes toner stored in the developing casing 206. Specifically, the image formation section 13 spends toner in the developing casing 206 by forming solid toner consumption multiple segment patterns 100 of FIG. 5 on the surfaces of the respective photoconductive members 21Y-K thereof. As an ordinary image formation operation, the toner consumption patterns are formed through a charge process that charges a surface of a photoconductive member with a charge device, a latent image formation process that forms a latent image on the photoconductive member with an image writing device, and a developing process that visualizes the latent image on the photoconductive member with a developing device.

The control device 4 includes a CPU or the like employed in the electro-photographing apparatus. Further included are a determination section 5, a memory section 6, a consumption toner amount determination section 7, and a replenishment toner amount determination section 8.

Information representing necessity of toner replacement for a selected sheet is previously designated in the determination section 5 per type of a sheet. Specifically, the determination section 5 determines if the selected sheet necessitates toner replacement.

In the memory 6, information that represents an amount of toner to be replaced when toner replacement is executed is stored. Specifically, a toner amount table that designates a consumption toner amount and a replenishment toner amount per sheet type is stored in the memory 6 as shown in FIG. 6.

Figures 6, 7:
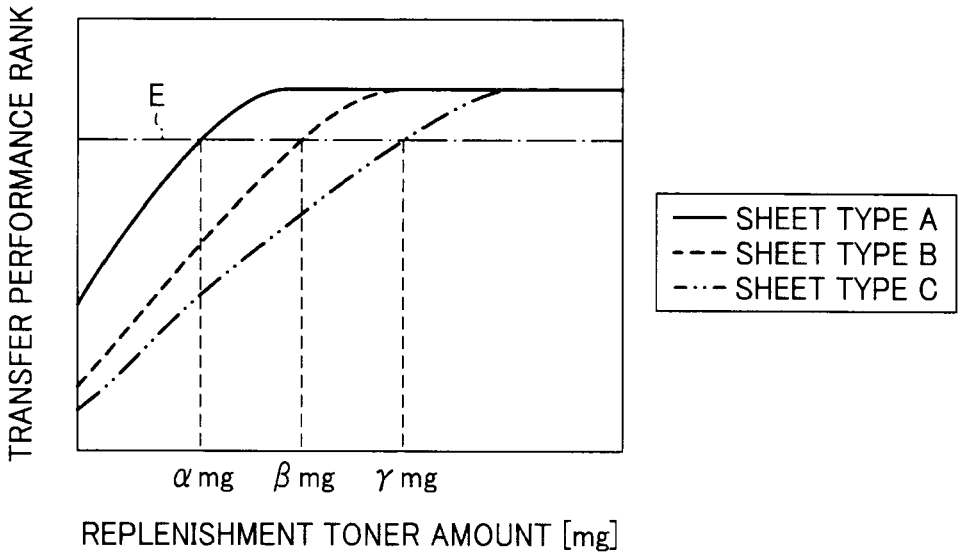
FIG. 6 illustrates an exemplary table showing a relation between a paper type and an amount of toner replaced.
FIG. 7 illustrates an exemplary relation between an amount of toner replaced and a transfer performance rank.

The consumption toner amount determination section 7 determines an amount of consumption toner in accordance with a selected sheet with reference to the toner amount table of FIG. 6 based on the information stored in the memory 6. The replenishment toner amount determination section 8 determines an amount of replenishment toner in accordance with the selected sheet with reference to the toner amount table of FIG. 6 based on the information stored in the memory 6.

The above-mentioned designation of the toner amount table is executed as follows. Initially, a test investigating a relation between an amount of toner replaced and a transfer performance rank on a sheet obtained after the toner replacement has been executed for each of sheet types A to C using an image forming apparatus (Imagio MPC 7500) manufactured by Ricoh Co, Ltd. Specifically, Image formation of a low image ratio is executed and the toner in the developing device is caused to degrade using the image forming apparatus. Then, images are outputted onto sheet types A to C, respectively, to evaluate sensitivity. After the outputs, consumption and replenishment of a prescribed amount of toner from and to the developing device are executed, and image are outputted, repeatedly. Then, a monitor (a person) evaluates the outputted images and determines a transfer performance rank. The Transfer performance rank is obtained by sensitively evaluating how a toner image is preferably transferred onto a concave section on a sheet having unevenness. For example, the highest rank is given when the toner image is not omitted by any amount even on the concave section. As an amount of omitting toner and such an area increases, the rank decreases as shown in FIG. 7.

Specifically, one dotted line E represents a lowest allowance limit of the transfer performance rank, and the transfer performance rank greater than the one dotted line E falls within the allowable range. In this embodiment, the amount of consumption and replenishment toner for each of the sheet types A to C of the table of FIG. 6 are xmg, ymg and zmg, respectively, which are the lowest allowable ranges of the transfer performance, respectively. That is, these values are designated in view of cost effectiveness by decreasing an amount of consumption toner as less as possible. However, when an image quality is prioritized, a greater amount of toner than the lowest allowable range can be designated.

Further, as shown in FIG. 6, the amount of consumption and that of replenishment toner is the same to each other for the purpose not to change toner density of the developer for each of the sheet types A to C. However, if printing with high toner density is intentionally desired or so, the replenishment amount of toner can be greater than the consumption amount thereof. By contrast, when printing with low toner density is intentionally desired or so, the replenishment amount of toner can be less than the consumption amount thereof.

Figure 5:
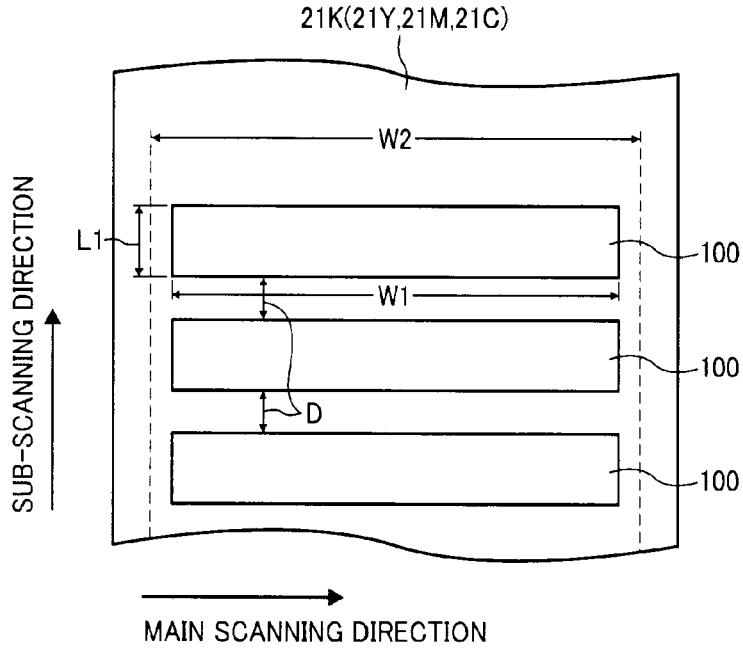
FIG. 5 schematically illustrates an exemplary method of forming a toner consumption pattern.

A calculation section 9 obtains information of a toner consumption amount determined by a consumption toner amount determination section 7 and calculates a number of toner consumption pattern formation times. As shown in FIG. 5, the toner consumption pattern formed per toner replenishment is divided into multiple segments of toner consumption multiple segment patterns 100 at a prescribed interval D in the sub scanning direction (i.e., a surface moving direction of a photoconductive member). A number of the toner consumption multiple segment patterns 100, i.e., a number of toner consumption multiple segment pattern formation times N, is calculated by the following manner.

As shown by the formula 1, an amount of consumption toner (Tc) consumed per replacement of toner becomes equivalent to a value obtained by multiplying an amount of toner attracted to one toner consumption pattern T100 by the number of toner consumption multiple segment pattern formation times N;

$$Tc\ [\mathrm{mg}]=T_{100}\ [\mathrm{mg}]\times N\ [\mathrm{times}] \tag{1}$$

Further, when a length of one toner consumption pattern in the sub scanning direction of FIG. 5 is L1 mm, a width thereof is W1, and a toner attraction amount per unit area of the surface of the photoconductive member is Tamg/cm2, the toner amount attracted to the one toner consumption multiple segment pattern is obtained by multiplying an area value, obtained by multiplying the length L1 of the toner consumption multiple segment pattern, i.e., L1, by the width W1 thereof, by the toner attraction amount Ta per unit area as calculated by the below described formula 2.

Such a length L1 and a width W1 are predetermined and set, and.

$$T_{100}\ [\mathrm{mg}]=L1\ [\mathrm{mm}]\times W1\ [\mathrm{mm}]\times Ta\ [\mathrm{mg/cm^2}] \tag{2}$$

The toner attraction amount Ta per unit area of the surface of the photoconductive member is previously measured.

Then, by substituting the above-mentioned formula 2 into the formula 1, the below described formula 3 calculating a number of formation times N of the toner consumption multiple segment patterns is obtained.

$$N\ [\mathrm{times}]=Tc\ [\mathrm{mg}]/(L1\ [\mathrm{mm}]\times W1\ [\mathrm{mm}]\times Ta\ [\mathrm{mg/cm^2}]) \tag{3}$$

Figure 8:
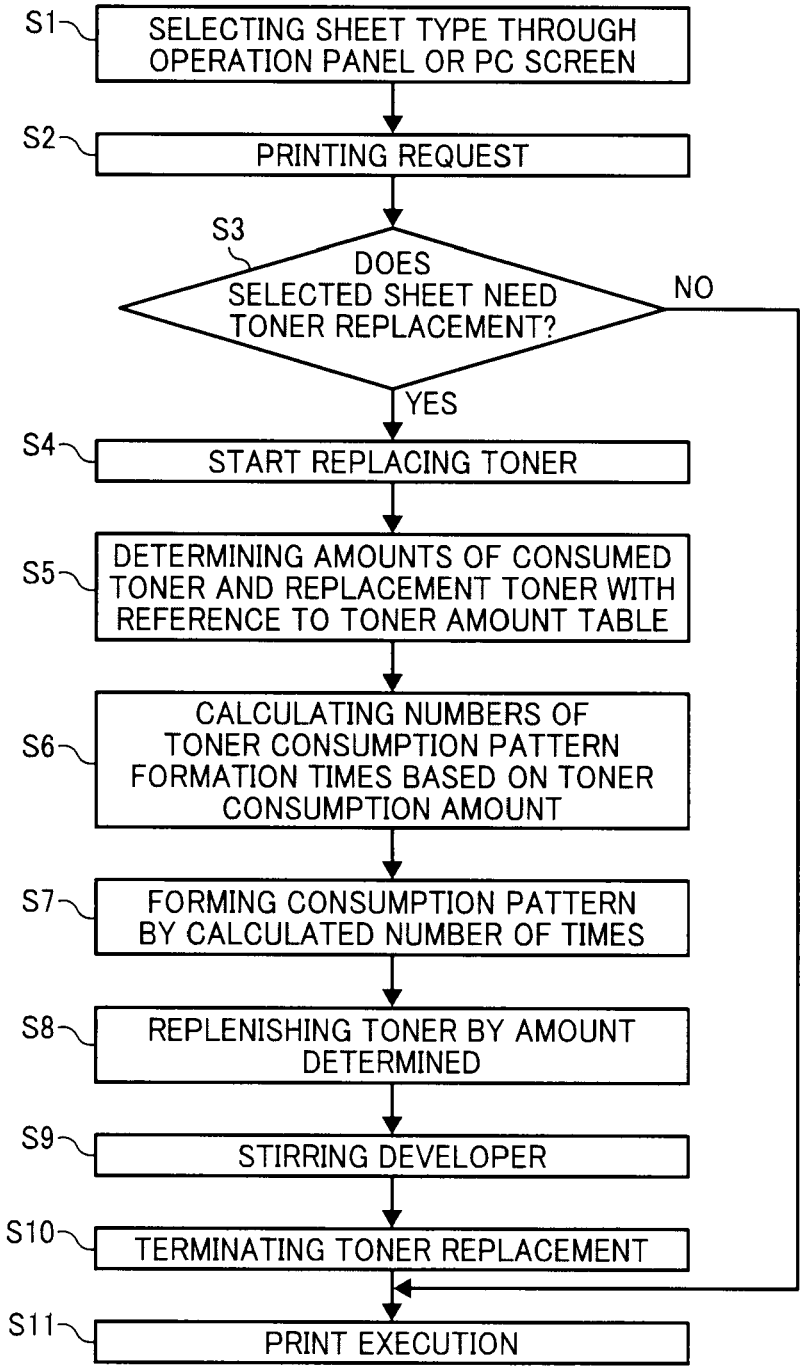
FIG. 8 illustrates an exemplary sequence showing an operation of toner replacement.

Now, an exemplary toner replacing operation executed when printing is executed is described with reference to FIG. 8.

First, when printing is to be executed, a sheet type is selected through one of the operation panel of the electro-photographing apparatus and the operation screen of the personal computer in step S1. Then, one of a copy button and a print button is depressed to request the printing in step S2. Then, it is determined if the sheet selected in step S1 necessitates toner replacement in step S3. The determination section 5 determinations the above-mentioned decision based on the type of sheet obtained from the recording medium selection device 2.

When the determination result is negative, the printing is immediately executed in step S11. Whereas, when the determination result is positive, the toner replacement operation is started in step S4.

When the toner is to be replaced, both a consumption toner amount and a replenishment toner amount are determined based on the sheet type selected in step S1 in step 5. Specifically, The consumption toner amount determination section 7 of FIG. 4 determines the consumption toner amount based on the selected sheet type with reference to a toner amount table stored in the memory section 6 of FIG. 4. Further, the replenishment toner amount determination section 8 of FIG. 4 determines a replenishment toner amount based on the selected sheet type with reference to a toner amount table stored in the memory section 6 of FIG. 4.

Subsequently, a numbers of toner consumption pattern formation times is calculated based on the consumption toner amount as determined in step S5 in step S6. Specifically, The calculation section 9 of FIG. 4 calculates the number of toner consumption pattern formation times based on the consumption toner amount determined by the consumption toner amount determination section 7 using the above-mentioned formula 3.

Then, the number of toner consumption multiple segment patterns calculated in step 6 are formed on the photoconductive member in step S7. The image formation section 13 of FIG. 4 forms the numbers of toner consumption multiple segment patterns upon receiving such information from the calculation section 9 that calculates thereof.

Subsequently, the amount of toner determined in step 5 is replenished into the developing device in step S8. The toner replenishment device 18 executes such replenishment by the amount upon receiving such information determined by the replenishment toner amount determination section 8.

Then, The pair of screws 203 and 204 are rotated, so that the developer is stirred in the developing device in step S9. Thus, the toner and replenished fresh toner are uniformly charged in the developing device.

In this way, the toner replacement is completed in step S10. Then, the printing is executed in step S11. In this way, since degraded toner decreases and instead fresh toner increases in the developing device during the replacement of the toner, a transfer performance of a toner image transferred onto a sheet can be improved. Accordingly, an excellent image can be obtained. Further, since the replenishment of the toner with fresh one is executed after the toner in the developing device has been consumed, the new fresh toner is avoided from being immediately consumed to form the toner consumption pattern. Thus, a lot of toner can be quickly replaced.

In addition to the sheet type determining if the toner is to be replaced, another condition of a deterioration level of tone can be used using a known technology. For example, a printing ratio is calculated per image formation, and the toner replacement is executed when the printing ratio is smaller than a prescribed level.

Further, the toner consumption pattern formed on the photoconductive member is never transferred onto the sheet, the toner thereof is removed therefrom by the fur brush 302 or the cleaning blade 301 of the photoconductive member-cleaning device 30 of FIG. 3. Alternatively, when the toner consumption pattern formed on the photoconductive member is transferred onto the intermediate transfer belt, the toner thereon can be removed therefrom by the cleaning blade 251 of the transfer cleaning device 25 or the like.

However, since a toner attraction amount of the toner consumption multiple segment pattern per unit is greater than that of a toner image formed in ordinary image formation when remaining on a photoconductive member or an intermediate transfer belt, if the toner consumption pattern is continuously formed on the photoconductive member or the intermediate transfer belt in the sub scanning direction, an amount of toner brought in the cleaning device increases per hour. As a result, a cleaning problem or a waste toner conveyance problem likely occurs after the cleaning.

Then, according to this embodiment, as shown in FIG. 5, the toner consumption pattern formed per toner replenishment is divided into multiple segments 100 at a prescribed interval D in the sub scanning direction. Owing to this, the amount of toner is decreasingly brought in the photoconductive member-cleaning device or the transfer member-cleaning device per hour, while preferably maintaining cleaning and waste toner conveyance functions.

Figure 9:
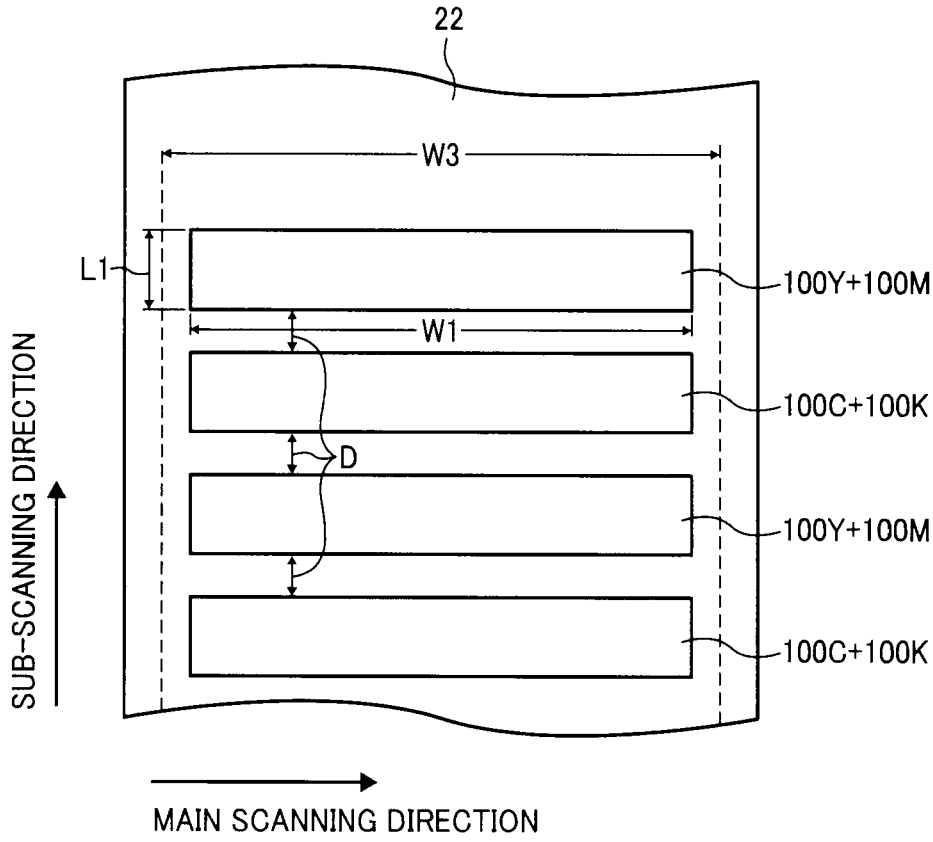
FIG. 9 schematically illustrates an exemplary manner of forming a toner consumption pattern.

Further, a width W1 of the toner consumption multiple segment patterns 100 in a main scan direction is 250 mm, for example, and is less than that W2 of the cleaning blade of the photoconductive member cleaning device in the main scan direction as shown in FIG. 5. Thus, toner is prevented from piling up at ends of the cleaning blade. Accordingly, the toner does not leak from the ends of the cleaning blade and hardly disturbs an image. Further, when a system removes a toner consumption pattern on the intermediate transfer belt, a width W1 of a toner consumption pattern in a main scan direction is less than that W3 of a cleaning blade of a transfer member cleaning device in a main scan direction as shown in FIG. 9, so that the same operation and advantage as mentioned above can be obtained.

Further, a length L1 of one of the toner consumption multiple segment patterns 100 in the subs direction can be changed in accordance with a consumption toner amount needed for toner replacement. However, to further decrease load of the toner consumption pattern on cleaning thereof and conveyance of the waste toner, the maximum value of the length L1 in the subs direction is preferably chosen to be 50 mm or the like, for example. Further, the interval D between the toner consumption multiple segment patterns 100 is preferably a level, such as 20 mm, etc., capable of suppressing cleaning and waste toner conveyance problems.

Further, since a toner consumption pattern is not transferred onto a sheet when the toner consumption pattern is transferred onto the intermediate transfer belt, the toner likely remains on the transfer conveyance belt 50 of FIG. 2. If the toner is attracted to the toner conveyance belt 50, the toner is further attracted and contaminates a sheet conveyed by the toner conveyance belt 50. In general, the toner conveyance belt 50 is not equipped with a cleaning device, or with simple cleaning device in view of cost saving, so that cleaning performance is low. Then, a contact and separation device is provided to cause the toner conveyance belt 50 to contact and separate from the intermediate transfer belt 22. Specifically, by separating the toner conveyance belt 50 from the intermediate transfer belt 22 when a toner consumption pattern is formed, toner is prevented from being attracted to the toner conveyance belt 50.

In this embodiment, when transferred onto the intermediate transfer belt, toner consumption patterns of respective component colors are transferred thereon not to overlap with each other. However, the toner consumption patterns of respective component colors can be transferred overlapping with each other as shown in FIGS. 9 and 10.

Figure 10:
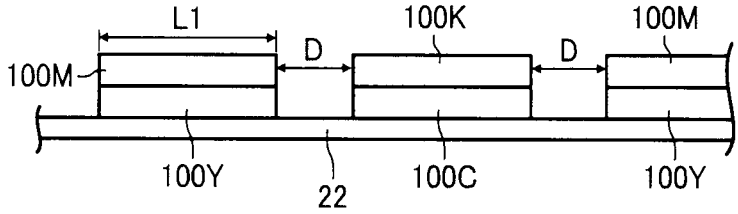
FIG. 10 schematically illustrates another exemplary manner of forming a toner consumption pattern.

As shown in FIGS. 9 and 10, respective two different toner consumption patterns of component colors 100Y-K are transferred overlapping with each other. Specifically, the toner consumption multiple segment pattern 100M of magenta overlies that of yellow, while the toner consumption multiple segment pattern 100K of black overlies that of cyan. However, the other combination can be employed.

Hence, since a transfer region of the toner consumption pattern on the intermediate transfer belt is more reduced in its sub-scanning direction when multiple toner consumption patterns are transferred overlapping with each other thereon, a time period for consuming the toner decreases in comparison when they are transferred being separated.

On the other hand, when the multiple toner consumption patterns are superimposed, the toner becomes to scatter easily. Specifically, since the toner on the intermediate transfer belt is held on the belt surface by electrostatic force, an attracting force of the intermediate transfer belt pulling the toner thereon decreases as a thickness of a toner layer increases, the toner increasingly tends to scatter due to repulsive force therebetween. Thus, in this embodiment, only two-component colors of the toner consumption patterns are overlapped on the intermediate transfer belt, and more than three of those do not overlap each other as shown in FIGS. 9 and 10, whereby toner scattering from the intermediate transfer belt can be prevented. As a result, both of the inside and the outside of a machine are not contaminated by the scattering toner.

At the same time, an amount of the toner brought into the cleaning device and the waste toner conveyance device per hour can be reduced. As a result, load on the cleaning device and the waste toner conveyance device can be relieved, whereby the cleaning and waste toner conveyance functions are preferably maintained.

Further, to decrease the amount of toner brought into the cleaning device per hour, a grid toner consumption pattern can be formed other than solid one (as mentioned above). However, although the amount of toner brought into the cleaning device per hour decreases when more than three component colors are superimposed, the toner likely scatters. Because, a toner layer becomes thicker at a section where grid patterns overlap with each other.

As different from the above-mentioned system, the toner consumption pattern can be removed by both of the photoconductive member cleaning and the transfer member cleaning devices. Specifically, the primary transfer bias applied to the respective primary transfer bias rollers 23Y-K of FIG. 2 is decreased by half as large as a bias used when an ordinary image is transferred. As a result, a transfer efficiency of a toner consumption pattern from the photoconductive member onto the intermediate transfer belt can be lowered than that when an ordinary image is transferred.

Thus, the toner consumption pattern can be separately carried on both of the photoconductive member and the intermediate transfer belt. As a result, an amount of toner attracted to the photoconductive member or the intermediate transfer belt decreases in comparison with when the toner consumption pattern is only carried on one of thereof. Thus, an amount of the toner brought into each of the cleaning devices can be reduced. As a result, load on the cleaning device and the waste toner conveyance device can be further relieved.

Now, an exemplary vacuuming device 70 provided in the respective developing devices 20Y-K are described with reference to FIG. 11. A non-limited vacuuming device 70 is also described with reference to FIGS. 12 and 13.

Figure 11:
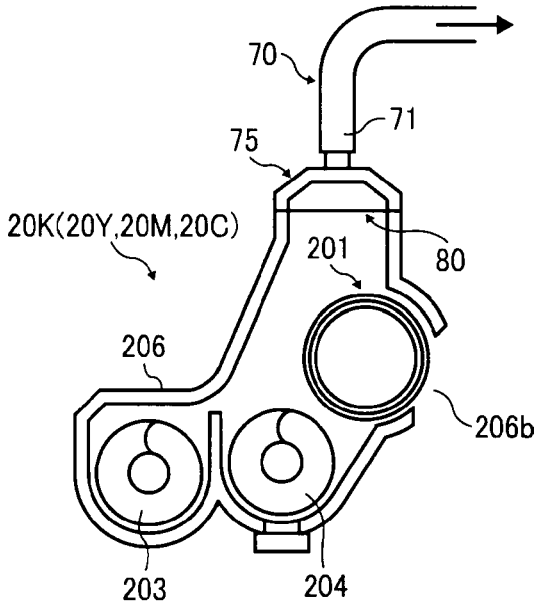
FIG. 11 illustrates an exemplary electro-photographic apparatus including a vacuuming member in the developing device according to one embodiment of the present invention.
Figure 12:
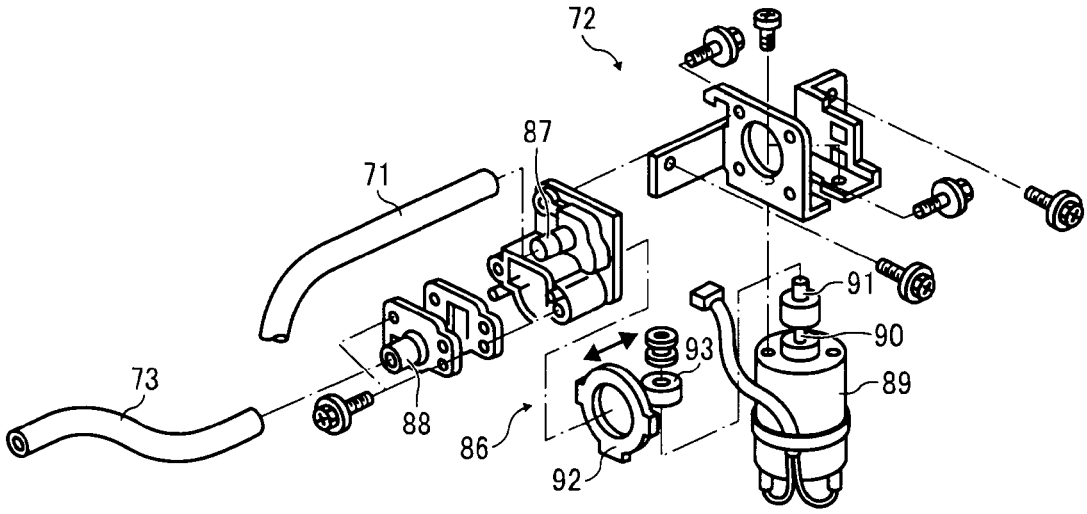
FIG. 12 partially illustrates the exploded vacuuming member of FIG. 11.
Figure 13:
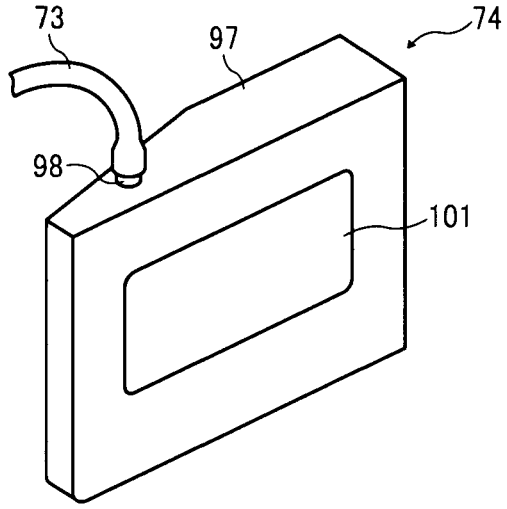
FIG. 13 partially illustrates the vacuuming member with a schematic view.

The above-mentioned vacuuming device 70 includes a vacuuming duct 75 as shown in FIG. 11, an evacuation device 72 as shown in FIG. 12, and a toner storage device 74 as shown in FIG. 13. Also included are an air intake tube 71 that connects the vacuuming duct 75 to the evacuation device 72, and an evacuation tube 73 that connects the evacuation device 72 to the toner storage device 74.

As shown in FIG. 11, an opening section 80 is formed on the developing casing 206. The vacuuming duct 75 is attached to the opening section 80. The vacuuming duct 75 has an elongated rectangular shape and is arranged along the longitudinal direction of the developing device. Further, one end of the air intake tube 71 is attached to a center on the upper surface of the vacuuming duct 75.

As shown in FIG. 12, the evacuation device 72 includes a pump 86 and a motor 89 that drives the pump 86. The other end of the air intake tube 71 is attached to an air intake vent 87 of the pump 86. One end of the evacuation tube 73 is attached to the evacuation opening 88 of the pump 86. Further, an eccentric pin 91 attached to a driving shaft 90 of the motor 89 fits into a section 93 of a rubber member 92 included in the pump 86.

As shown in FIG. 13, the toner storage device 74 includes a tank 97 having a prescribed width, height, and depth, arranged in the electro-photographing apparatus. On the upper surface of the tank 97, there is provided an inlet 98 connecting to the other end of the evacuation tube 73. Further, a toner capturing device 101 made of drawn porous PTFE serving as a filter is attached to the tank 97 to close an opening, not shown, formed thereon.

When the vacuuming device 70 is operated, the motor 89 is driven cooperating with a developing motor, not shown, to reciprocate the center of the rubber member 92 in directions as shown by arrows in FIG. 12. Further, by opening and closing the air intake and evacuation bulbs, not shown, respectively, the vacuuming duct 75 vacuums and conveys air from the developing casing 206 to the pump 86 through the air intake tube 71. Then, by closing and opening the air intake and evacuation bulbs, respectively, the air in the pump 86 is conveyed to the toner storage device 74 through the evacuation tube 73.

Thus, by driving the above-mentioned vacuuming device 70 and vacuuming the air of the developing device from the vacuuming duct 75 when the toner is replaced, toner floating in the developing device can be vacuumed. Further, by vacuuming the air in the developing device and generating a vacuuming air stream at the opening section 206*b* of the developing casing 206 of FIG. 3, vacuuming in neighboring air, scattering of the toner from the developing device can be prevented or suppressed.

In this way, by arranging the vacuuming device 70 in the developing device, scattering of the toner from the developing device can be prevented or suppressed and as a result, both of the inside and outside of the machine are prevented from being contaminated.

Further, the vacuuming device 70 can be operated during a normal operation other than the above-mentioned toner replacement operation to effectively prevent toner scattering from the developing device. In such a situation, by increasing a vacuuming force of the vacuuming device 70 during toner replenishment operation than the normal operation, the toner scattering from the developing device can more likely prevented even during the toner replacement operation generally highly likely causing the scattering thereof.

The vacuuming device 70 can employ a fan to vacuum and evacuate air instead of the above-mentioned pump 86. Further, the tank 97 as an evacuation destination of the pump 86 can be omitted, and only the toner-capturing device 101 can collect the scattering toner by itself.

ADVANTAGE

As mentioned above, according to the present invention, necessity of replacement of toner is determined in accordance with a type of a selected sheet, it is only executed upon necessity. As a result, toner consumption caused by toner replacement can be reduced, so that a running cost therefor can be decreased.

According to the present invention, a transfer performance can be improved even a sheet, which is produced by an embossing process or the like having a large surface unevenness pattern, is utilized, even being impossible in the past.

In addition to the above-mentioned color electro-photographing apparatus of FIG. 1, a monochrome image forming apparatus or another type of an image forming apparatus can adopt the present invention.

Numerous additional modifications and variations of the present invention are possible in light of the above teachings. It is therefore to be understood that, within the scope of the appended claims, the present invention may be practiced otherwise than as specifically described herein.

What is claimed is:

1. An image forming apparatus for forming a visual image on a recording medium, comprising:

at least one photoconductive member configured to carry a latent image;

at least one developing device configured to store toner and develop the latent image with the toner;

at least one toner replacing device configured to replace the toner stored in the developing device with fresh toner; and a determiner configured to determine if a recording medium selected by a user necessitates replacement of toner;

a transfer member configured to receive a toner image from the at least one photoconductive member, wherein said toner replacing device replaces the toner with fresh toner when the determiner determines that the recording medium necessitates replacement of the toner before a visual image is formed on the photoconductive member, wherein said at least one photoconductive member includes at least two photoconductive members configured to carry latent images, said at least one developing device includes at least two developing devices configured to develop the latent images formed on the at least two photoconductive members, respectively, wherein said toner is consumed before being replaced with fresh toner by forming toner consumption patterns on the surfaces of the at least two photoconductive members, respectively, and removing the toner consumption patterns from one of the at least two photoconductive members and a transfer member receiving toner consumption patterns from the at least two photoconductive members, wherein said respective toner consumption patterns are superimposed on the same section of the transfer member, and wherein no more than three-toner consumption patterns are superimposed on the same section of the transfer member.

2. The image forming apparatus as claimed in claim 1, wherein an amount of said toner stored in the developing device replaced by the at least one toner replacing device is changed in accordance with a type of the recording medium selected by the user.

3. The image forming apparatus as claimed in claim 2, further comprising a memory configured to store information regarding said amount of toner to be replaced by the toner replacing device per type of a recording medium, wherein said amount of the toner to be replaced is determined in accordance with the information stored in the memory.

4. The image forming apparatus as claimed in claim 1, further comprising at least one vacuuming device configured to vacuum air in the at least one developing device when the toner is replaced.

5. The image forming apparatus as claimed in claim 4, wherein said at least one vacuuming device vacuums the air more intensely when the toner is replaced than when operating in an ordinary operation.

6. The image forming apparatus as claimed in claim 1, wherein said toner is replaced with fresh toner after the toner stored in the at least one developing device has been consumed.

7. The image forming apparatus as claimed in claim 1, wherein toner consumption patterns are arranged on the surface of the at least one photoconductive member at a prescribed interval in a surface moving direction.

8. The image forming apparatus as claimed in claim 1, further comprising:

at least one cleaning member configured to execute cleaning, wherein a width of the toner consumption pattern is smaller than that of the at least one cleaning member.

9. The image forming apparatus as claimed in claim 1, further comprising:

at least one cleaning member configured to execute cleaning, wherein a transfer efficiency of the toner consumption patterns transferred from the at least one photoconductive member onto the transfer member is lower than that of a toner image transferred from the at least one photoconductive member onto the transfer member during a normal toner image transfer operation.

* * * * *